US006789450B1

(12) United States Patent
Helfet

(10) Patent No.: US 6,789,450 B1
(45) Date of Patent: Sep. 14, 2004

(54) MANUALLY OPERATED STRAP WRENCH FOR TURNING GENERALLY CYLINDRICAL OBJECTS

(76) Inventor: Leon Helfet, 1539 San Rafael Way, Camarillo, CA (US) 93012

( * ) Notice: Subject to any disclaimer, the term of this patent is extended or adjusted under 35 U.S.C. 154(b) by 0 days.

(21) Appl. No.: 10/189,365

(22) Filed: Jul. 1, 2002

Related U.S. Application Data

(60) Provisional application No. 60/304,551, filed on Jul. 11, 2001.

(51) Int. Cl.[7] ..... B25B 13/52
(52) U.S. Cl. ..... 81/64; 81/3.43
(58) Field of Search ..... 81/3.43, 64

(56) References Cited

U.S. PATENT DOCUMENTS

| | | | | |
|---|---|---|---|---|
| 624,253 | A | 5/1899 | Rudebock | |
| 627,075 | A | 6/1899 | Gifford | |
| 896,696 | A | 8/1908 | Lind | |
| 1,268,129 | A | 6/1918 | Larick et al. | |
| 1,478,724 | A | 12/1923 | Barchus | |
| 1,512,014 | A | 10/1924 | Bryar | |
| 1,600,541 | A | 9/1926 | Fischer | |
| 1,625,258 | A | 4/1927 | Jelbert, Jr. | |
| 1,828,106 | A | 10/1931 | Ertola | |
| 2,094,238 | A | 9/1937 | Koenig | |
| 2,181,012 | A | * 11/1939 | Bunting | 81/64 |
| 2,498,934 | A | 2/1950 | Webb | |
| 2,522,190 | A | 9/1950 | Mouser | |
| 2,566,108 | A | 8/1951 | Anderson | |
| 2,693,015 | A | 11/1954 | Richards et al. | |
| 2,914,831 | A | 12/1959 | McBrien | |
| 3,023,649 | A | 3/1962 | Wallace | |
| 3,133,463 | A | 5/1964 | Davis, III | |
| 3,200,676 | A | 8/1965 | Pagel | |
| 3,851,548 | A | 12/1974 | Rutz | |
| 4,150,591 | A | 4/1979 | Ackeret | |
| 4,532,833 | A | 8/1985 | Downs | |
| 4,987,804 | A | 1/1991 | Greenwalt | |
| D328,554 | S | 8/1992 | Cobble | |
| 5,509,705 | A | 4/1996 | Woodsum | |
| 6,125,723 | A | 10/2000 | Huang | |
| 6,196,090 | B1 | 3/2001 | Dumont | |
| 6,367,355 | B1 | 4/2002 | Tanne | |
| 2002/0092381 | A1 * | 7/2002 | Khubani | 81/64 |

FOREIGN PATENT DOCUMENTS

| | | |
|---|---|---|
| EP | 0 618 045 A1 | 3/1994 |
| FR | 1.570.027 | 6/1969 |

* cited by examiner

*Primary Examiner*—James G. Smith
(74) *Attorney, Agent, or Firm*—Jack C. Munro

(57) ABSTRACT

A strap wrench for turning generally cylindrical objects where the strap wrench includes a manually rotatable thumb wheel which is mounted within a handle. Rotation of the thumb wheel produces lineal movement of a strap that attaches to the handle. The strap wrench is firmly mounted about a generally cylindrical object and applying a twisting force to the strap wrench is to result in turning movement of the generally cylindrical object.

4 Claims, 4 Drawing Sheets

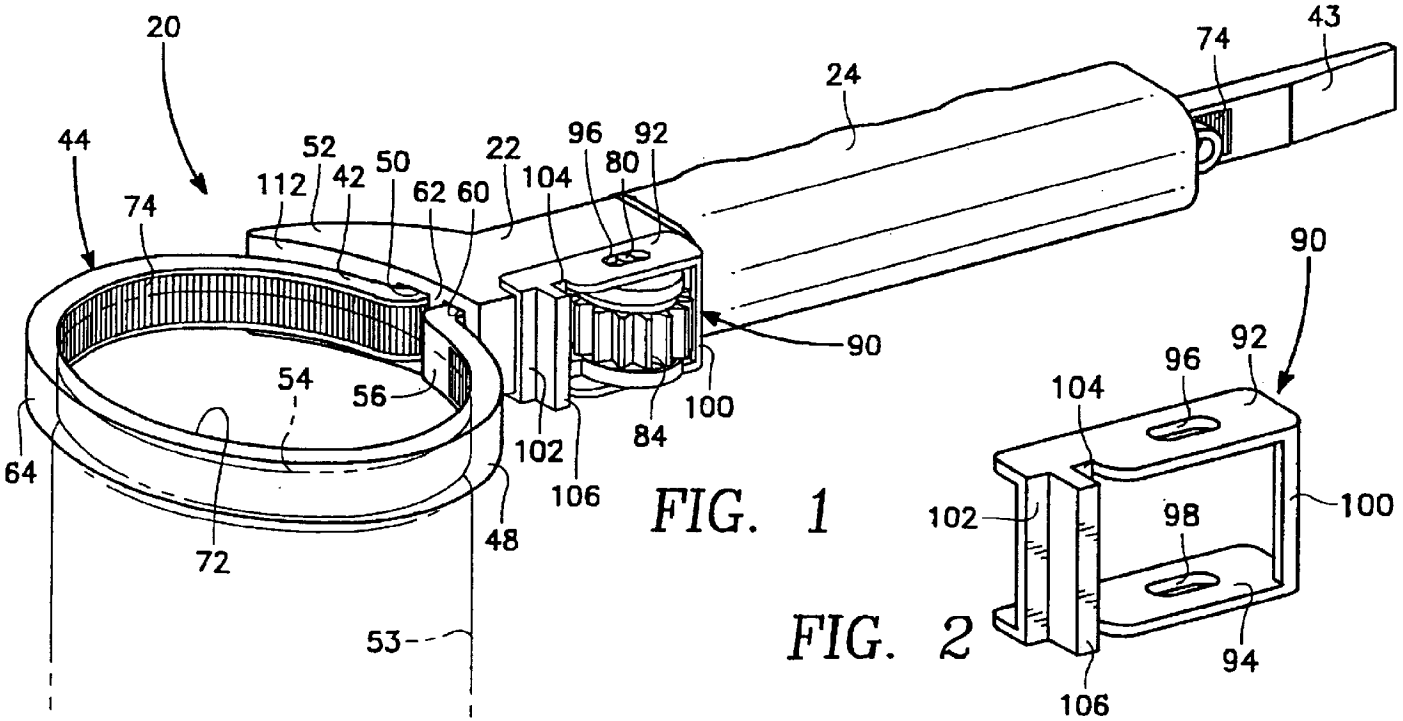
FIG. 1
FIG. 2
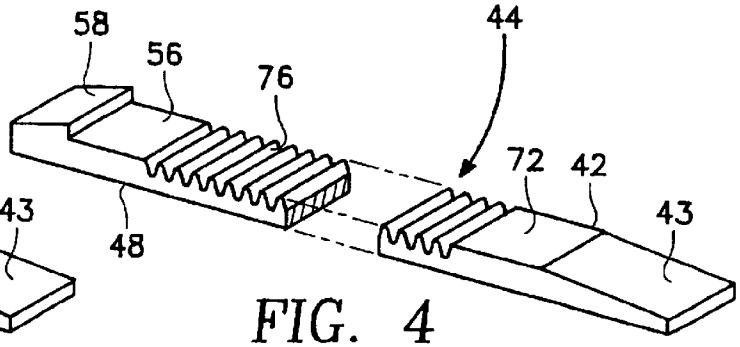
FIG. 4
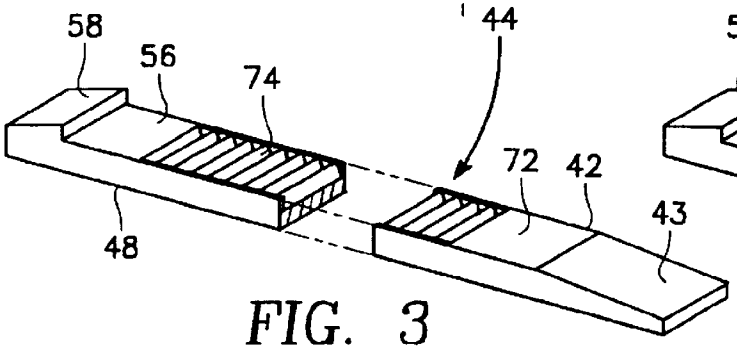
FIG. 3

MANUALLY OPERATED STRAP WRENCH FOR TURNING GENERALLY CYLINDRICAL OBJECTS

This application is to reference U.S. Provisional patent application serial No. 60/304,551, filed Jul. 11, 2001, entitled CAP GRIPPER by the present inventor.

BACKGROUND OF THE INVENTION

1. Field of the Invention

A strap wrench for turning of an object of general overall cylindrical shape. The strap wrench is formed of a handle which has mounted therewithin a strap. One end of the strap is fixed to the handle and the opposite end of the strap is movable relative to the handle. A portion of the strap is formed into a loop which is placed around the object that is to be turned.

2. Description of the Related Art

Many containers, such as bottles, jars, and cans utilize a cap which is threaded thereon. In most instances, when it is desired to remove one of the caps, such can be accomplished relatively easily by most individuals. However, for some individuals, this removal technique is difficult. Older people or people with arthritis find it exceedingly difficult to exert adequate force for affecting removal of such caps. Also, some caps are so tight that even strong men cannot remove such. One could use a conventional tool, such as pliers or a pipe wrench. However, many caps are too large to be usable in conjunction with plier or even a pipe wrench. Also, the use of such plier type of tools exerts an uneven applied pressure on the cap which may cause damage to the cap and the container on which it is mounted making it difficult to reinstall the cap.

Although the subject matter of this invention has been found to be especially useful when removing of caps on containers, it is considered to be within the scope of this invention that the tool could be used in conjunction with any generally cylindrical object, such as a pipe, a fastening nut, a water valve handle, a pulley and any other similar type of relatively round device that it is necessary to apply torque to this device. As far as this invention goes, a generally cylindrical object is meant to include hexagonal shaped threaded nuts, elliptically shaped water valve handles, pipes, container lids and other similar objects.

In the past, it has been known to construct what is called a strap wrench where there is utilized an elongated strap, usually made of rubber or fabric, that can be placed about the generally cylindrical object. The strap can be tightened on the cylindrical object and a force applied to the generally cylindrical object to cause such to be turned to loosen the object although the force could be applied to tighten the object. There have been numerous different types of such strap wrenches constructed in the past. For the most part, these strap wrenches have been constructed so that the strap can be easily disconnected from the handle on which it is mounted such as by having the strap merely fall sideways through a slot in the handle. When the strap is disconnected from the handle, it cannot be used in the desired manner. Also, strap wrenches of the prior art have been constructed to be reasonably costly. There is a need to construct a strap wrench which can operate efficiently with a minimal amount of effort and which can be constructed at a relatively inexpensive cost and therefor sold to the ultimate consumer at an inexpensive cost.

SUMMARY OF THE INVENTION

The first basic embodiment of strap wrench of the present invention comprises a handle which has an internal chamber.

A frontal access opening is formed within the handle with this frontal access opening connecting with the internal chamber. A strap terminates in a fixed end and a movable end with the fixed end being fixed to the handle adjacent the frontal access opening. The movable end extends through the frontal access opening into the internal chamber, The strap is formed into an encircling loop located directly adjacent and exterior of the frontal access. A thumb wheel is mounted on the handle. The thumb wheel engages with the movable end of the strap. Manual movement of the thumb wheel causes movement of the movable end of the strap which expands or contracts the size of the encircling loop which will permit tightening of the encircling loop on a generally cylindrical object for the purpose of causing turning movement of the object by the application of a manual twisting force of the handle.

A further embodiment of the present invention is where the first basic embodiment is modified by the handle being elongated.

A further embodiment of the present invention is where the first basic embodiment is modified by the movable end of the strap being permitted to extend exteriorly of the handle through a rear access opening formed in the handle.

A further embodiment of the present invention is where the fixed end of the strap is secured to the handle directly adjacent the frontal access opening.

A further embodiment of the present invention is where the first basic embodiment is modified by the including of a shoe on the handle located directly adjacent the frontal access opening with this shoe to be pressed tightly against the strap and against the generally cylindrical object which assists in securing in a fixed position the encircling loop of the strap on the generally cylindrical object.

A further embodiment of the present invention is where there is included within the internal chamber of the handle an idler roller with the movable end of the strap continuously riding against the idler roller facilitating its lineal movement by rotation of the thumb wheel.

A further embodiment of the present invention is where the first basic embodiment is modified by the including of first gear teeth on the movable end of the strap and the including of second gear teeth on the thumb wheel with the second gear teeth of the thumb wheel to engage the first gear teeth.

A further embodiment of the present invention comprises modifying of the basic embodiment by the including of a locking device that is slidably mounted on the handle that is to be engaged with the thumb wheel to fix the position of the thumb wheel in position when a tightened position of the strap has been obtained.

A further embodiment of the present invention comprises modifying the first gear teeth on the movable end of the strap by locating the first gear teeth on the inside surface of the strap.

A further embodiment of the present invention is where the just previous embodiment is modified by the including of the idler roller within the internal chamber of the handle with this idler roller to be in continuous contact with the movable end of the strap.

A further embodiment of the present invention is where the just previous embodiment is modified by the including of the slidable locking device on the handle that is to engage with the thumb wheel to lock the thumb wheel in a fixed position thereby fixing the encircling loop in a fixed position on the generally cylindrically shaped object.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 1 is an isometric view of the strap wrench of the present invention;

FIG. 2 is an isometric view of just the locking mechanism that is utilized in conjunction with the strap wrench of FIG. 1;

FIG. 3 is an isometric view of one configuration of strap that could be utilized in conjunction with the strap wrench in FIG. 1;

FIG. 4 is an isometric view of a second configuration of a strap that could be utilized with the strap wrench of FIG. 1;

DETAILED DESCRIPTION OF THE INVENTION

Figure 5:
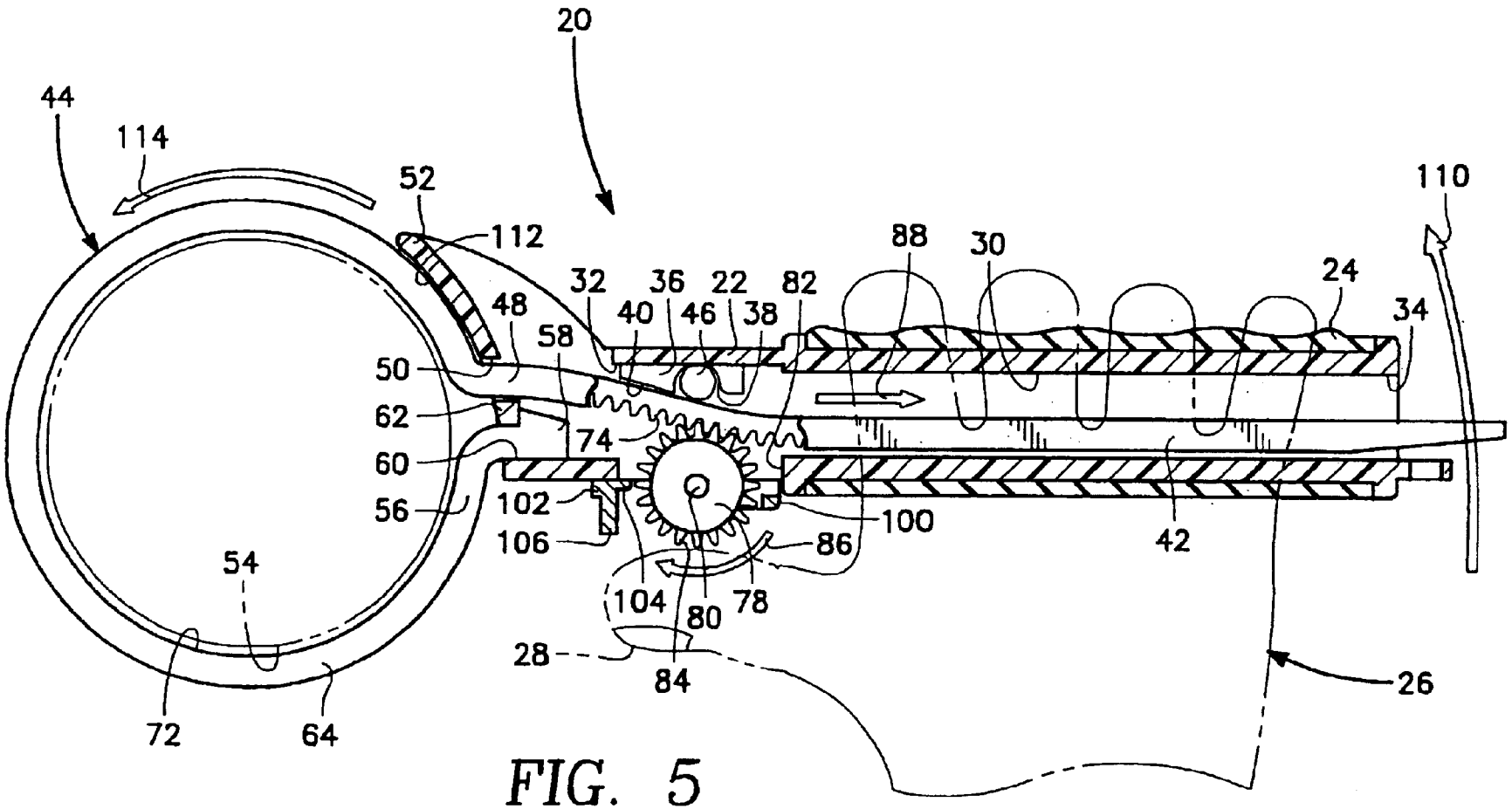
FIG. 5 is a longitudinal side cross-sectional view of the strap wrench of FIG. 1 depicting tightening operation of the strap wrench on the generally cylindrical object.
Figure 6:
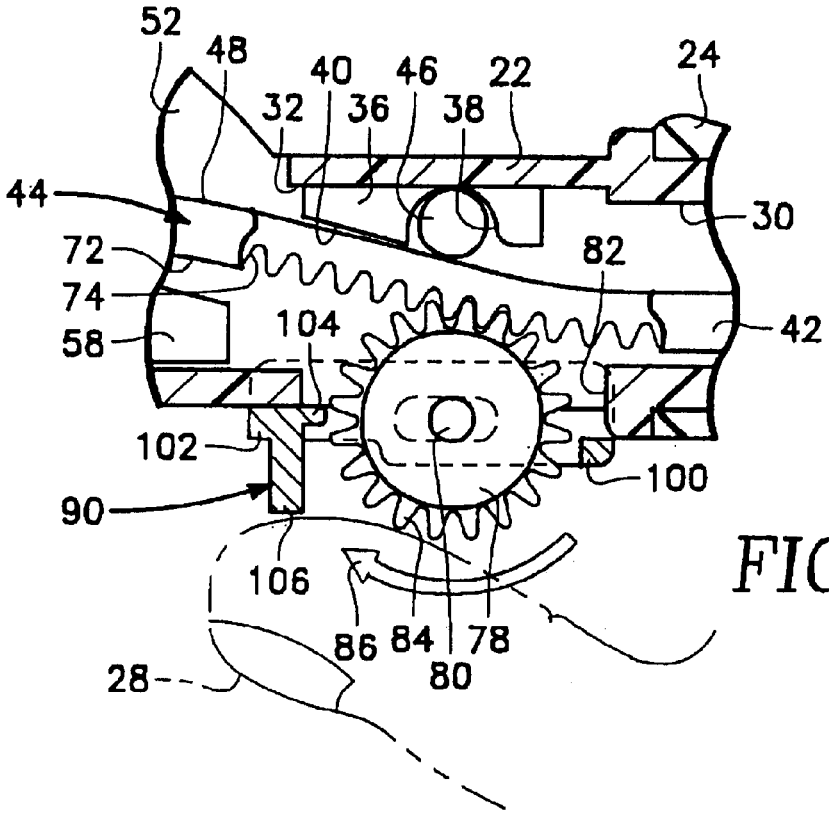
FIG. 6 is an enlarged cross-sectional view of the thumb wheel portion of the strap wrench of this invention again depicting the tightening operation of the strap wrench on the generally cylindrical object.
Figure 7:
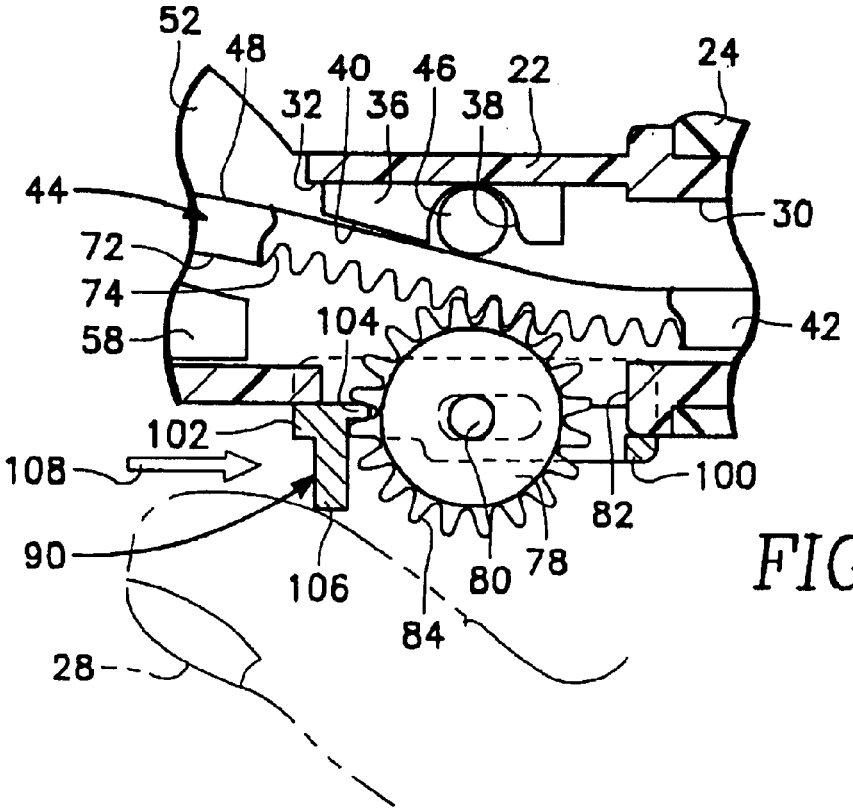
FIG. 7 is a view similar to FIG. 6 but showing the locking mechanism in the locked position in conjunction with the thumb wheel.

Referring particularly to FIGS. 1 and 5-7 of the drawings, there is shown the strap wrench 20 of this invention. The strap wrench 20 includes an elongated handle 22 which has an exteriorly mounted grip 24. Grip 24 will normally be constructed of a resilient material, such as a rubber or rubberized plastic. The grip 24 has a basically convoluted shape which is to facilitate connection to the user's hand 26. The user's hand 26 includes a thumb 28.

The handle 22 includes an internal chamber 30. The internal chamber 30 is open at the front end by a frontal access opening 32 and also open at the rear end by a rear access 34. Fixedly mounted on the wall surface of the internal chamber 30 is a guide ramp 36. The guide ramp 36 has an exterior inclined surface 40 and an enlarged transverse groove 38. The surface 40 will actually include a plurality of longitudinal slots, which are not shown. The purpose of the longitudinal slots is to provide a minimal amount of surface area on the surface 40 so that the movable end 42 of a strap 44 will function to easily slide on the surface 40. Mounted within the groove 38 is a small cylindrical member defined as an idler roller 46. This idler roller 46 is also to be pressed against by the movable end 42 and further facilitate low frictional movement of the movable end 42 relative to the handle 22. It is to be noted that the roller 46 and the surface 40 presses against the planer exterior surface 48 of the strap 44.

The movable end 42 of the strap 44 is conducted through hole 50 formed within a shoe 52. The movable end 42, after being conducted through the hole 50, is passable through the frontal access opening 32 and through the internal chamber 30 and may protrude exteriorly of the handle 22 out through the rear access opening 34. The fact that the end of the strap 44 has a taper 43 facilitates the insertion through the frontal access opening 32. If the generally cylindrical object 54 is of a rather small diameter, then almost assuredly the movable end 42 will protrude exteriorly of the rear access opening 34. However, if the object 54 is of a rather large diameter, the movable end 42 may not protrude at any time from the rear access opening 34. Object 54 is shown to be a cap on a container (bottle or jar) 53.

Figure 8:
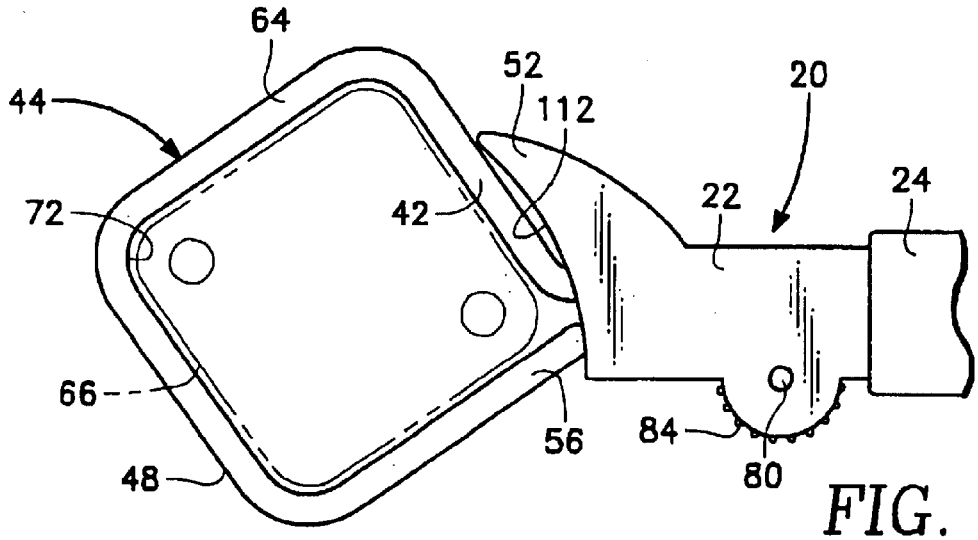
FIG. 8 is a side view of a portion of the strap wrench showing the strap wrench mounted on a square shaped object.
Figure 9:
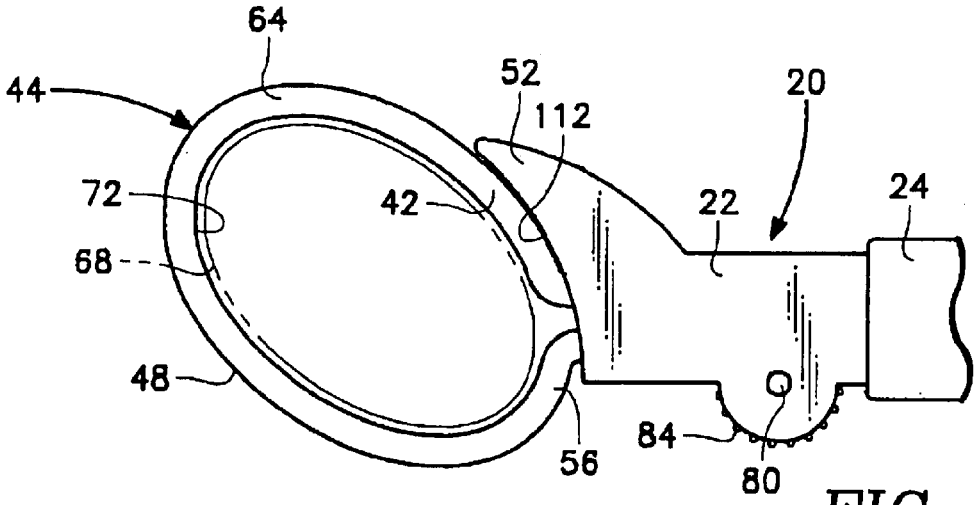
FIG. 9 is a view similar to FIG. 8 but showing the strap wrench mounted on an elliptical shaped object.
Figure 10:
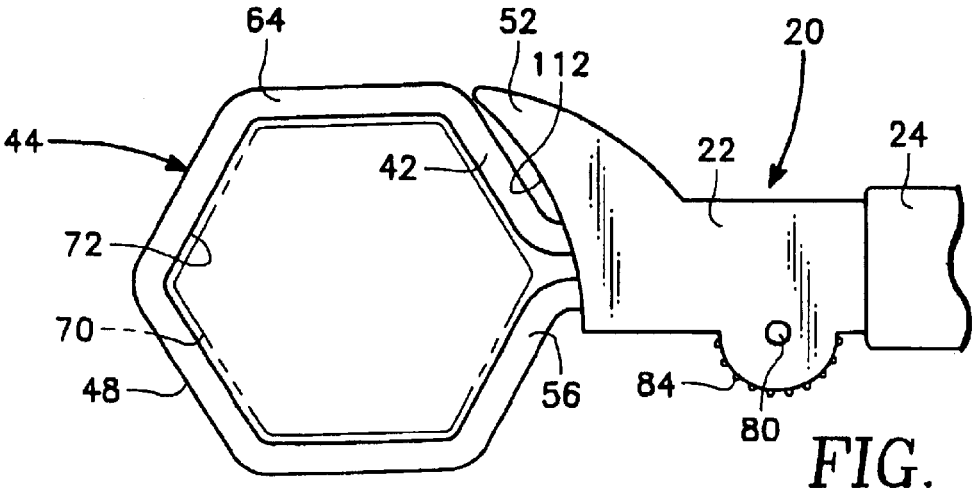
FIG. 10 is a view similar to FIG. 9 but showing the strap wrench mounted on a hexagonal shaped object.

Fixed end 56 of the strap 44 includes a hook 58. The hook 58 is to be forcibly moved through hole 60 formed within the shoe 52. The hook 58, after being forced through the hole 60, will expand and be caught by dividing wall 62 which separates holes 50 and 60. The hook 60 will be pressed against the dividing wall 62 thereby fixedly locating fixed end 56 to the handle 22. Exteriorly of holes 58 and 60, the strap 44 forms an encircling loop 64. The encircling loop 64 is to be placed around the object 54 that is to be turned. The object 54 can be cylindrical, as is shown in FIG. 5, or could have another shape which will be referred to as far as this invention goes as being generally cylindrical however, really not cylindrical. For example, the object 66 could be square, as is shown in FIG. 8. It is known that some can, bottle or jar lids are square. In FIG. 9, the object 68 is elliptical and a common form of an elliptical shaped object would be a handle for a water valve located underneath a sink or in conjunction with a toilet in a home or office. In FIG. 10, the object 70 is hexagonal shaped with again some lids being in this shape.

The inside surface 72 of the strap 44 includes a series of first gear teeth 74. The gear teeth 74 are closed at each longitudinal end, as is clearly shown in FIGS. 1 and 3 of the drawings. However, the first gear teeth 74 could be open at each longitudinal end, as is shown by first gear teeth 76 in FIG. 4. The first gear teeth 74 or 76 is to be in continuous engagement with the thumb wheel 78 which is pivotally mounted by means of a pivot pin 80 on the handle 22. The thumb wheel 78 is mounted within a hole 82 which is formed within the handle 22. A portion of the thumb wheel 78 is located within the internal chamber 30 and also is located exteriorly of the handle 22. Exteriorly formed on the thumb wheel 78 is a continuous series of second gear teeth 84. The second gear teeth 84 are in continuous engagement with the first gear teeth 76. When a manual force is applied by the thumb 28 against the thumb wheel 78 tending to rotate thumb wheel 78 in the direction of arrow 86, the movable end 42 of the strap 44 is moved lineally in the direction of arrow 88. This movement is to occur until the encircling loop 64 tightly surrounds the object 54, 66, 68 or 70. Again, the lineal movement of the movable end 42 is facilitated by sliding against the surface 40 and the free rotation that is permitted by the idler roller 46.

Once the encircling loop 64 is tightly around the object 54, 66, 68 or 70, it may be desirable to fix the position of the thumb wheel 78 in order to maintain whatever firm grasp is obtained by the loop 64 on the object. For that purpose, there may be provided a locking mechanism in the form of a frame 90 which is mounted against the handle 22. The frame 90 has sidewalls 92 and 94 within which respectively are elongated holes 96 and 98. The pivot pin 80 is to connect with the holes 96 and 98 with the frame 90 being mounted in conjunction with the handle 22. The frame 90 has mounted thereon a rearwardly located brace bar 100. The brace bar 100 is located between the sidewalls 92 and 94 and provides support for the rear portion of the frame 90. Support for the front portion of the frame 90 between the sidewalls 92 and 94 is provided by a plate 102. The rear edge of the plate 102 is formed into a narrowed member defined as a rib 104. Mounted on the plate 102 and extending outwardly therefrom is a bar 106.

When the user desires to fix in position the thumb wheel 78 and the encircling loop 64 is tightly placed about the object 54, 66, 68 or 70, the user slips his or thumb 28 onto the bar 106. The user then moves the bar 106 and the entire frame 90 rearwardly in the direction of arrow 108 until the rib 104 becomes located between a directly adjacent pair of the second gear teeth 84. Further rotational movement of the thumb wheel 78 is now prevented and the user is able to remove his or her thumb 28 from the thumb wheel 78 and the strap wrench 20 will remain in its fixed position on the object. Normally at this time, the user will apply a manual turning movement in the direction of arrow 110 on the handle 22 which will press the surface 112 against the exterior surface 48 of the encircling loop 64. As a result, the strap 44 is clamped between the surface 112 and the surface of the object 54, 66, 68 or 70. This force of clamping is to prevent slippage of the encircling loop 64 relative to the object 54, 66, 68 or 70. As the user applies more and more force on the handle 22, at some point in time the object 54, 66, 68, of 70 will be loosened and will be turned in the direction of arrow 114. Generally, when the object 54, 66, 68 of 70 has been loosened, the strap wrench 20 is disengaged from the object by applying pressure in the opposite direction on bar 106 which will release the rib 104 from the engagement with the second gear teeth 84 with further manual movement of the object to occur strictly by the applying of the user's hand.

It is to be understood that the strap wrench 20 can also be used in a similar manner to effect tightening of an object onto an appropriate structure, such as a container, or tightening of a valve, and so forth. When tightening, the shoe 52 is moved one hundred and eighty degrees from the position shown in FIG. 5.

What is claimed is:

1. A strap wrench for turning a generally cylindrical object comprising:

a handle having an internal chamber, a frontal access opening formed in said handle, said frontal access opening connecting with said internal chamber;

a strap terminating in a fixed end and a movable end, said fixed end being fixed to said handle, said movable end extending through said frontal access opening into said internal chamber, said strap being formed into an encircling loop located directly adjacent said frontal access opening;

a thumb wheel mounted on said handle, said thumb wheel engaging with said movable and within said internal chamber, manual movement of said thumb wheel causes movement of said movable end which expands or contracts the size of said encircling loop; and said handle having an idler roller, said idler roller being mounted within said internal chamber, said movable end of said strap to be in continuous contract with said idler roller, whereby said idler roller facilitates movement of said strap by application of rotational movement from said thumb wheel.

2. A strap wrench for turning generally cylindrical object comprising:

a handle having an internal chamber, a frontal access opening formed in said handle, said frontal access opening connecting with said internal chamber;

a strap terminating in a fixed end and a movable end, said fixed end being fixed to said handle, said movable end extending through said frontal access opening into said internal chamber, said strap being formed into an encircling loop located directly adjacent said frontal access opening;

a thumb wheel mounted on said handle, said thumb wheel engaging with said movable end within said internal chamber, manual movement of said thumb wheel causes movement of said movable end which expands or contracts the size of said encircling loop;

said strap wrench having a longitudinal series of first gear teeth, said thumb wheel having a series of second gear teeth, said second gear teeth being continuous, said second gear teeth to engage with said first gear teeth and upon manual rotational movement of said thumb wheel said strap is moved lineally; and means for locking mounted on said handle, said means for locking to be manually engagable with said thumb wheel to lock the position of said thumb wheel, said means for locking being movable to a disengaging position to permit rotation of said thumb wheel.

3. A strap wrench for turning a generally cylindrical object comprising:

a handle having an internal chamber, a frontal access opening formed in said handle, said frontal access opening connecting with said internal chamber;

a strap terminating in a fixed end and a movable end, said fixed end being fixed to said handle, said movable end extending through said frontal access opening into said internal chamber, said strap being formed into an encircling loop located directly adjacent said frontal access opening;

a thumb wheel mounted on said handle, said thumb wheel engaging with said movable end within said internal chamber, manual movement of said thumb wheel causes movement of said movable end which expands or contracts the size of said encircling loop;

said strap wrench having a longitudinal series of first gear teeth, said thumb wheel having a series of second gear teeth, said second gear teeth being continuous, said second gear teeth to engage with said first gear teeth and upon manual rotational movement of said thumb wheel said strap is moved lineally;

said strap having an interior surface and an exterior surface, said interior surface to be in direct contact with said generally cylindrical object, said first gear teeth being mounted on said interior surface; and said handle having an idler roller, said idler roller being mounted within said internal chamber, said movable end of said strap to be in continuous contract with said idler roller, whereby said idler roller facilitates movement of said strap by application of rotational movement from said thumb wheel.

4. The strap wrench as defined in claim 3 wherein:

means for locking mounted on said handle, said means for locking to be manually engagable with said thumb wheel to lock the position of said thumb wheel, said means for locking being movable to a disengaging position to permit rotation of said thumb wheel.

* * * * *